US008479844B2

(12) United States Patent
Blangé

(10) Patent No.: US 8,479,844 B2
(45) Date of Patent: Jul. 9, 2013

(54) DISTANCE HOLDER WITH JET DEFLECTOR

(75) Inventor: Jan-Jette Blangé, Rijswijk (NL)

(73) Assignee: Shell Oil Company, Houston, TX (US)

( * ) Notice: Subject to any disclaimer, the term of this patent is extended or adjusted under 35 U.S.C. 154(b) by 332 days.

(21) Appl. No.: 12/531,499

(22) PCT Filed: Mar. 20, 2008

(86) PCT No.: PCT/EP2008/053340
§ 371 (c)(1),
(2), (4) Date: Dec. 16, 2009

(87) PCT Pub. No.: WO2008/113843
PCT Pub. Date: Sep. 25, 2008

(65) Prior Publication Data

US 2010/0084195 A1 Apr. 8, 2010

(30) Foreign Application Priority Data

Mar. 22, 2007 (EP) ..... 07104670

(51) Int. Cl.
*E21B 10/60* (2006.01)
*E21B 7/18* (2006.01)

(52) U.S. Cl.
USPC ..... 175/393; 175/67; 239/518

(58) Field of Classification Search
USPC ..... 239/518, 524; 299/16, 17, 81.1, 299/81.3; 405/240, 248; 175/424, 393, 67
See application file for complete search history.

(56) References Cited

U.S. PATENT DOCUMENTS

| | | | | |
|---|---|---|---|---|
| 2,931,187 | A * | 4/1960 | Perkins | 405/13 |
| 3,576,222 | A | 4/1971 | Acheson et al. | 175/67 |
| 3,924,698 | A | 12/1975 | Juvkam-Wold | 175/393 |
| 3,938,600 | A * | 2/1976 | Essmeier | 175/424 |
| 5,651,420 | A * | 7/1997 | Tibbitts et al. | 175/102 |
| 5,887,667 | A * | 3/1999 | Van Zante et al. | 175/67 |
| 5,944,123 | A * | 8/1999 | Johnson | 175/73 |
| 6,510,907 | B1 * | 1/2003 | Blange | 175/67 |
| 6,702,940 | B2 * | 3/2004 | Blange | 210/222 |
| 7,017,684 | B2 * | 3/2006 | Blange | 175/424 |
| 7,322,433 | B2 * | 1/2008 | Blange | 175/424 |
| 7,419,014 | B2 * | 9/2008 | Blange | 175/54 |
| 7,448,151 | B2 * | 11/2008 | Blange | 37/318 |
| 7,493,966 | B2 * | 2/2009 | Blange | 175/54 |
| 2004/0094332 | A1 * | 5/2004 | Blange | 175/424 |
| 2006/0266554 | A1 * | 11/2006 | Blange | 175/54 |
| 2007/0079993 | A1 * | 4/2007 | Blange | 175/393 |

FOREIGN PATENT DOCUMENTS

| | | |
|---|---|---|
| WO | WO0234653 | 5/2002 |
| WO | WO02092956 | 11/2002 |
| WO | WO2005040546 | 5/2005 |
| WO | WO 2005040546 A1 * | 5/2005 |

* cited by examiner

*Primary Examiner* — William P Neuder
*Assistant Examiner* — Wei Wang

(57) ABSTRACT

A distance holder for connection to, and rotation with, a drill string in an earth formation drilling device arranged to supply a jet of abrasive fluid for the purpose of providing a borehole by removing earth formation material through abrasion, comprises a chamber that is essentially rotational symmetric and which faces the earth formation material, and a jet nozzle arranged for discharging a jet of the abrasive fluid in the chamber. The chamber comprises a deflector positioned in the path of the fluid jet discharged from the jet nozzle.

11 Claims, 4 Drawing Sheets

DISTANCE HOLDER WITH JET DEFLECTOR

PRIORITY CLAIM

The present application claims priority from PCT/EP2008/053340, filed 20 Mar. 2008, which claims priority from EP Application 07104670.0, filed 22 Mar. 2007.

BACKGROUND OF THE INVENTION

The invention is related to a distance holder for connection to, and rotation, with a drill string in an earth formation drilling device arranged to supply a jet of abrasive fluid for the purpose of providing a borehole by removing earth formation material through abrasion, where the distance holder comprises a chamber that is essentially rotational symmetric and which faces the earth formation material, and a jet nozzle arranged for discharging a jet of the abrasive fluid in said chamber.

Such a distance holder is disclosed in WO-A-2005/040546. Said prior art distance holder provides an abrasive fluid jet which is directed towards a slot in the circumference of the chamber. The jet, which is directed through the slot, exerts an abrasive action on the earth formation within the chamber whereby a cone shaped bottom is obtained. Subsequently, the jet direction is reversed by the lowest part of the bottom into an upward direction. The cuttings or abraded particles as well as the abrasive particles are transported to the surface by the fluid; at some height above the bottom the abrasive particles are extracted from the fluid and fed back into the jet nozzle. By means of the fluid that is jetted through the nozzle, the abrasive particles enter a new cycle of abrasive action, and so on.

In practice it appears that the wall of the hole thus obtained lacks a certain smoothness. A good borehole quality is however important for obtaining earth formation data by means of sensors. Pad-type down-hole evaluation sensors are applied onto the wall of the borehole, and the contact between such sensors and said wall is gravely impaired by a less than smooth borehole wall quality. Moreover, parasitic pressure losses may occur, and furthermore borehole cleaning by the fluid flow through the annulus towards the surface may be impaired. Also, energy is lost when forming grooves in the rough borehole wall.

SUMMARY OF THE INVENTION

The object of the invention is therefore to provide a distance holder of the type described before which allows the drilling of a smoother borehole. Said object is achieved by providing the chamber with a deflector positioned in the path of the fluid jet discharged from the jet nozzle.

The distance holder according to the invention, first of all allows the borehole bottom to be abraded by the fluid jet which is issued from the jet nozzle. Subsequently, as said abrasive fluid jet collides with the deflector, the direction of the jet is changed to an orientation which comes closer to the vertical direction. The jet thus obtains an almost vertically downwardly orientated direction, which is decisive for obtaining a smooth borehole wall instead of a grooved one.

The prior art distance holder comprises a jet nozzle which is oriented obliquely with respect to the axis of rotation for making the jet of abrasive fluid intersect the borehole axis. Thus, a borehole bottom is formed which has the cone shape. According to the invention however, a borehole bottom is formed which has a first cone with a certain top angle, and underneath a second, truncated cone with a smaller top angle than the top angle of the first cone. These top angles can be influenced by the orientation of the jet nozzle and by the orientation of the deflector. In this connection, preferably the deflector is oriented for deflecting the jet of abrasive fluid in a direction enclosing an angle with the axis of rotation which is smaller than the angle enclosed by the jet nozzle and said axis of rotation.

More preferably, the angle enclosed by the jet nozzle and the axis of rotation is approximately twice the angle enclosed by the deflector and the axis of rotation, when seen in a section according to a radial plane which includes the center line of the jet nozzle.

After abrading the earth formation, the abrasive fluid jet reaches the lowest parts of the borehole bottom at the foot of the lowermost cone and will have subsequently to flow back in upward direction through the annulus. As a result of the limited play between the outer surface of the distance holder and the borehole wall, the fluid could continue upwardly along the outside of the distance holder. However it is preferred to make the fluid flow in a circumferential direction, and to this end the deflector and the radial plane that includes the center line of the jet nozzle may enclose an angle that differs from 90 degrees.

The circumferential flow component may in particular be applied in an embodiment of the distance holder wherein the outermost end of the chamber comprises an essentially cylindrical skirt that extends over at least a part of the circumference of the chamber, the skirt being provided with at least one slot, and the deflector adjoining the slot.

The deflector directs the fluid flow in a circumferential direction through the slot towards the outside of the distance holder, after which the fluid flow will be oriented upwardly. In this connection, the deflector may extend slantingly between an end adjoining the skirt and an end adjoining the slot. The skirt has an outer surface and an inner surface; preferably the distance of the deflector, near or at the end adjoining the skirt, to the axis of rotation is approximately the same as the radius of the skirt inner surface. At the end adjoining the slot, the distance of the deflector to the axis of rotation is approximately the same as the radius of the skirt outer surface.

The deflector itself can be carried out in several ways; preferably said deflector comprises at least one plate, e.g. of tungsten carbide. However, the deflector may also comprise assembled plates.

Good results are obtained in case the size of the deflector, when seen in circumferential direction, is approximately the same as the width of the abrasive fluid jet at the position of the deflector and issued by the jet nozzle. Preferably, the deflector comprises an inwardly facing planar deflector surface.

Reference is made to the jet cutting device with deflector as disclosed in WO-A-02/092956. Said prior art deflector does not form part of the chamber included in a distance holder. Thus, the effects obtained by said prior art deflector are not the same and cannot provide the required smoothness of the borehole wall.

BRIEF DESCRIPTION OF THE DRAWINGS

The invention will now be described further with reference to an embodiment of the distance holder as shown in the drawings.

DETAILED DESCRIPTION OF PREFERRED EMBODIMENTS

Figure 1:
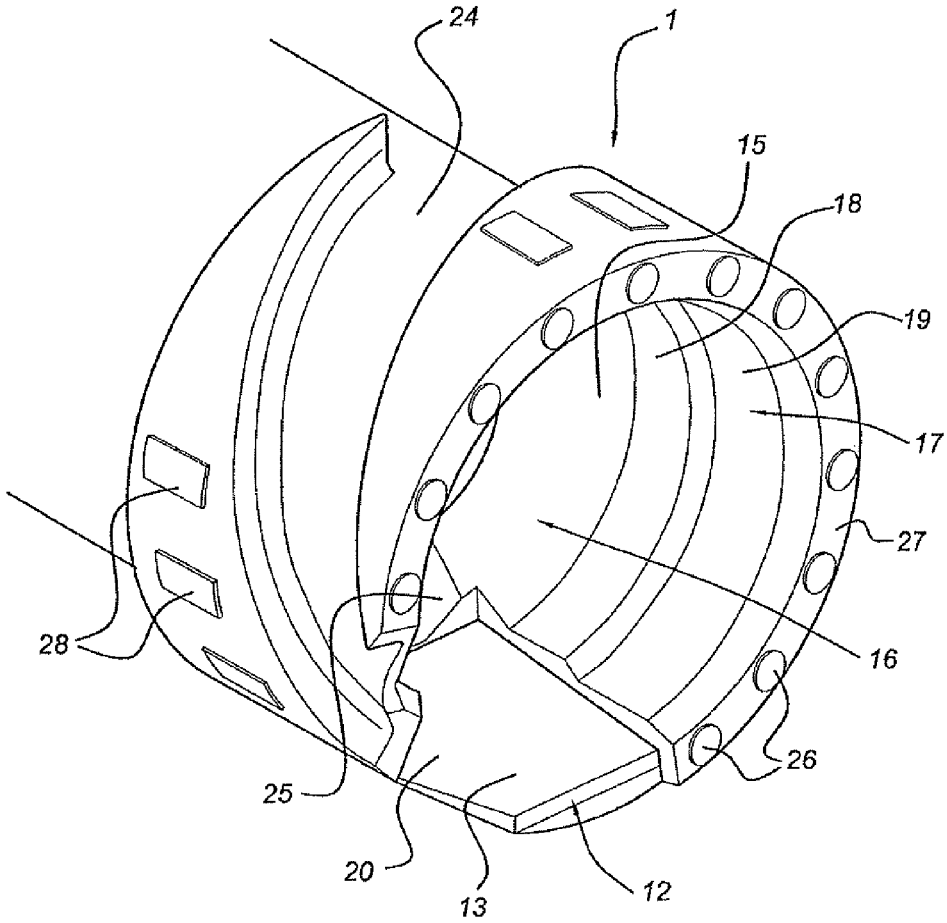
FIG. 1 shows a first view in perspective of the distance holder according to the invention.
Figure 2:
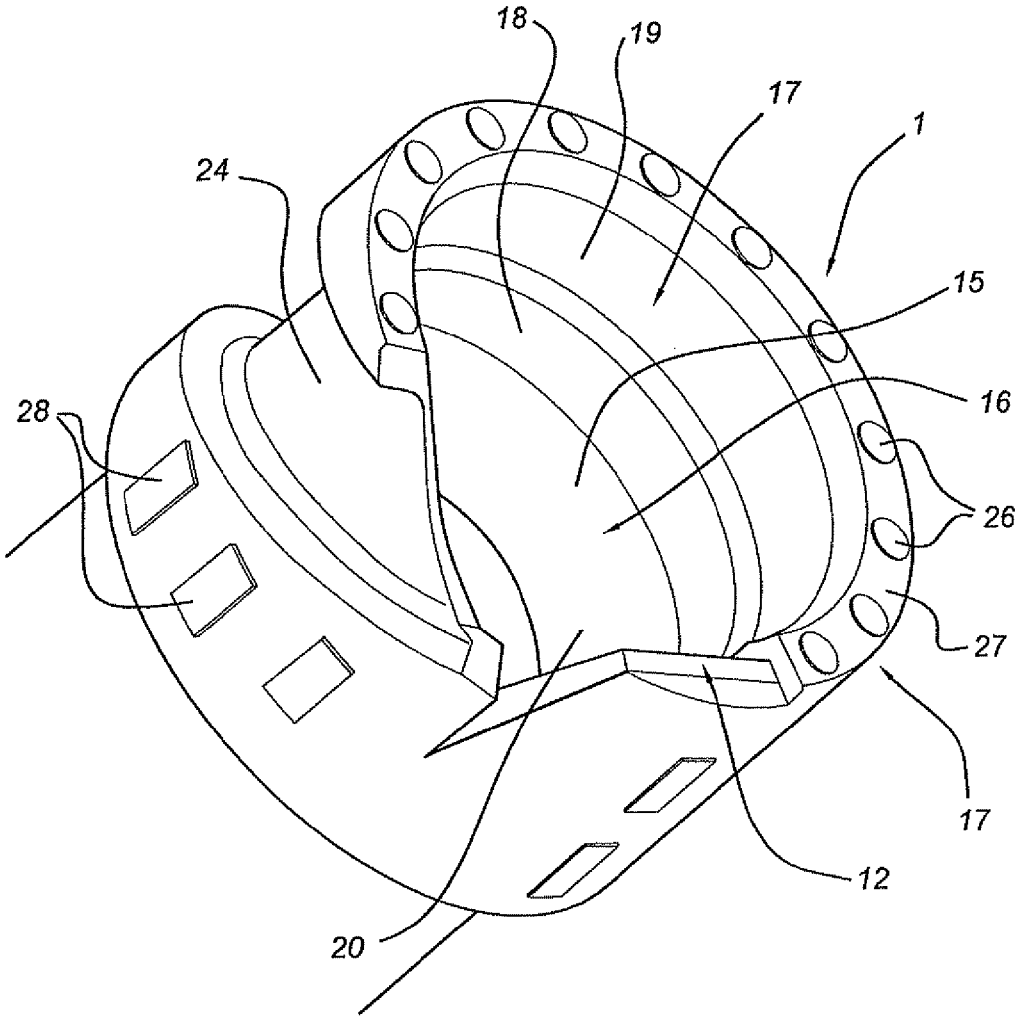
FIG. 2 shows a second view in perspective of the distance holder.
Figure 3:
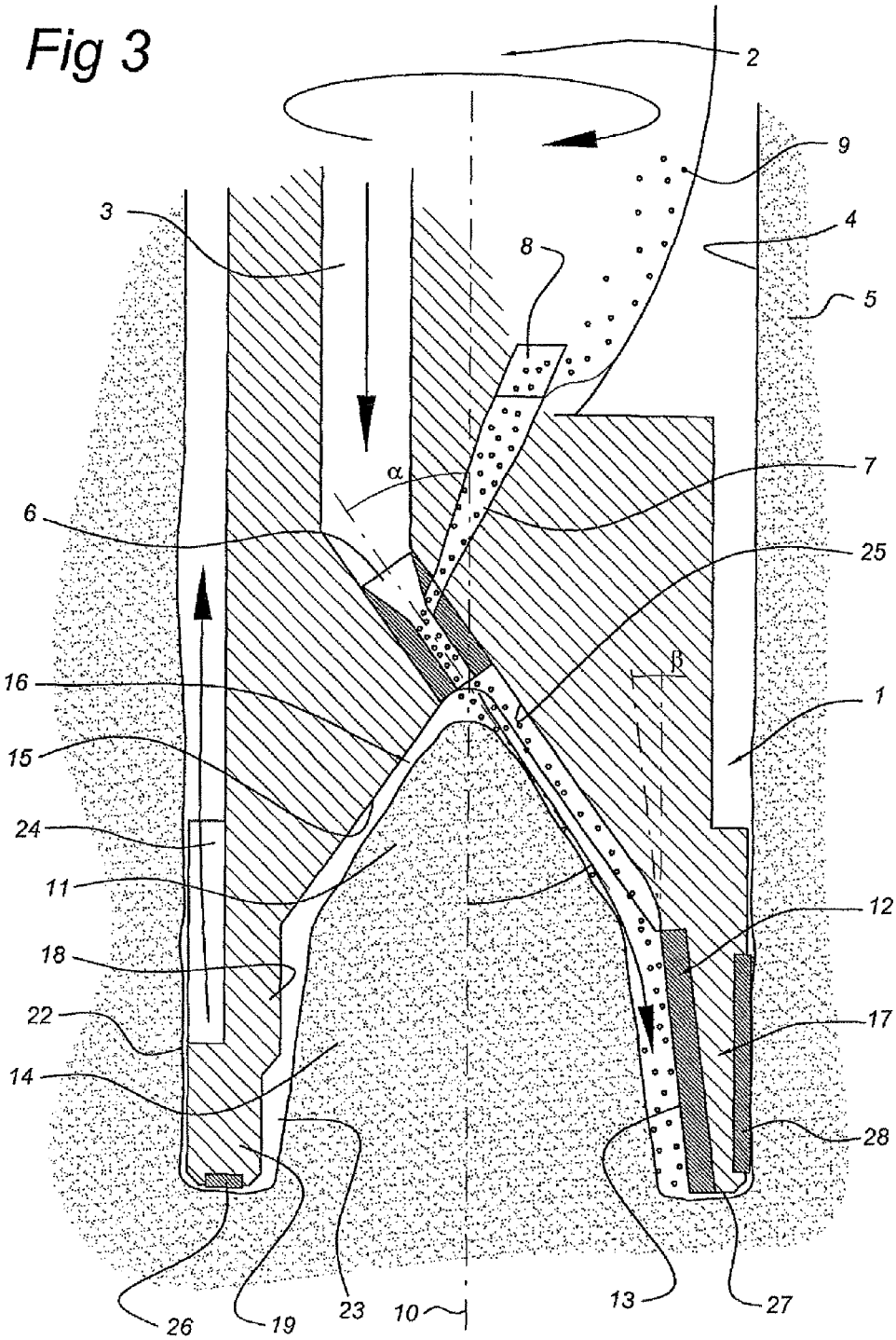
FIG. 3 shows a vertical cross-section through the distance holder during service in a borehole.

The distance holder 1 as shown in the drawings 1-4 forms part of an earth formation drilling device and is connected to the drill string 2 as shown in FIG. 3. drill string 2 contains a feed channel 3 by means of which the pressurized fluid is fed to the bottom of the borehole 4 in the earth formation 5. The distance holder 1 comprises a jet nozzle 6 which on the one hand is connected to the feed channel 3 in the drill string 2 and on the other hand to the abrasive particles supply 7. This abrasive particles supply 7 is supplied with abrasive particles 8 which originate from the collecting surface 9, onto which said abrasive particles 8 are attracted by means of a magnet (not shown) beneath said surface 9.

As shown in FIGS. 1-4, the distance holder 1 comprises a chamber 16, which has a trumpet shaped upper part 15 as well as a generally cylindrical skirt 17. The jet nozzle 6 (FIGS. 3 and 4) discharges in a recess 25 provided in said trumpet shaped surface 15. In the embodiment shown, said cylindrical skirt 17 has concentric parts 18, 19 of different diameters; other embodiments are possible as well. As shown in FIG. 3, the center line of the jet nozzle 6 and the axis of rotation 10 enclose an angle $\alpha$. Moreover, jet nozzle 6 is positioned in such a way that the jet of abrasive fluid intersects the axis of rotation 10. Thereby, a first cone 11 is formed under the influence of the abrasive action of the particles 8.

After forming first cone 11, the jet of drilling fluid collides with the deflector 12, in particular the flat inner surface 13 thereof. Deflector 12, or the flat inner surface 13 thereof, and the vertical enclose an angle $\beta$ which is smaller than the angle $\alpha$ enclosed by the jet nozzle axis and the axis of rotation 10. In particular, angle $\beta$ can be half the angle $\alpha$. After colliding with deflector 12, the abrasive fluid continues its path downwardly into the borehole, but at a steeper angle. Thereby, a truncated cone 14 is formed, which has a smaller top angle than first cone 11. This path of the abrasive fluid jet provides a smooth character to wall 4 of the borehole.

Skirt 17 has a slot 20 through which the fluid flows out of chamber 16. Slot 20 is bordered by deflector 12. As shown in the figures, and in particular in FIG. 4, at the end of deflector 12 bordering slot 20, inner surface 13 of deflector 12 has a certain radial distance D1 to the axis of rotation 10. At the opposite end of deflector 12, as seen in circumferential direction, inner surface 13 has a distance D2 to the axis of rotation which is smaller than the distance D1. The distance D1 is about equal to the diameter of the outer surface 22 of skirt 17; the distance D2 is about equal to the diameter of the inner surface 23 of skirt 17. Thus, inner surface 13 of deflector 12 runs slantingly between said inner surface 23 and said outer surface 22 of the skirt.

Figure 4:
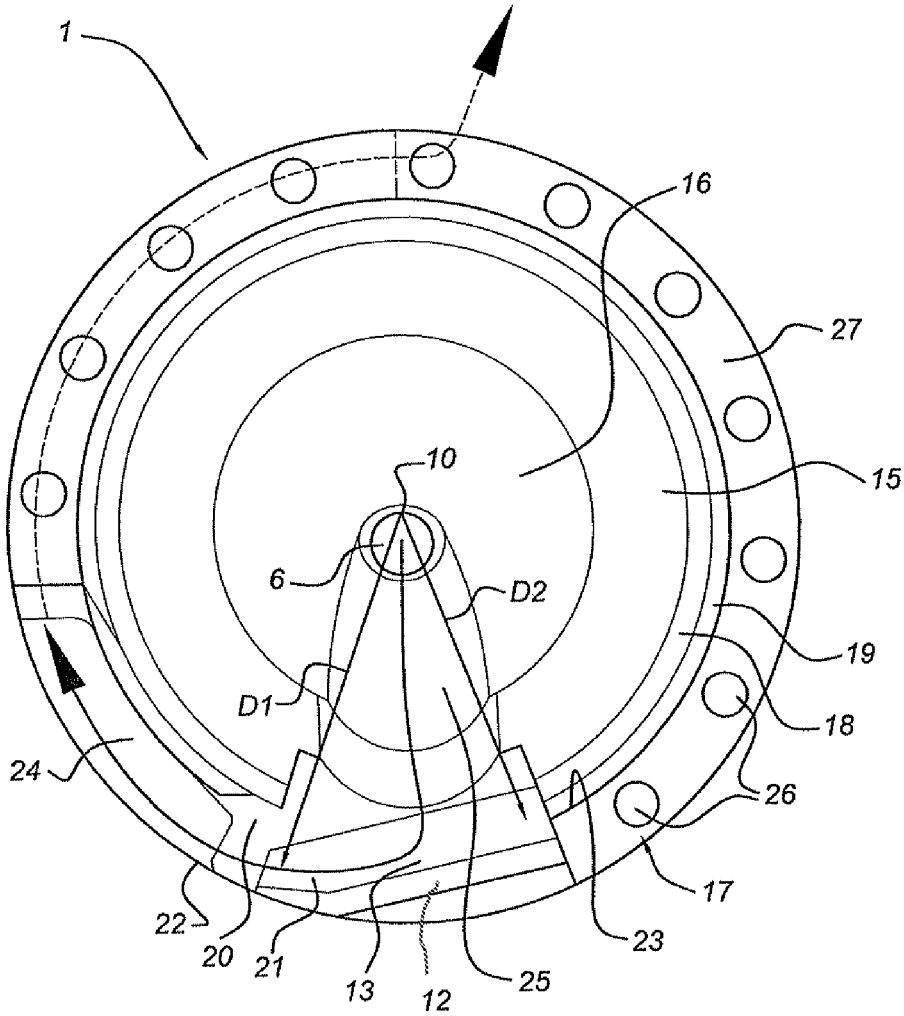
FIG. 4 shows a bottom view of the distance holder.

This orientation of the deflector 12 promotes the fluid flow as indicated by the arrow 21 in FIG. 4. After colliding with the deflector surface 13, the fluid does not only obtain a more steeply downwardly oriented direction, but also a component in circumferential direction. As the deflector surface 13 reaches a diameter D1 which is about equal to the diameter of the outer surface 22 of the skirt 17, the abrasive fluid is able to generate a hole with a sufficiently large diameter for accommodating the distance holder 12.

After said deflection of the abrasive fluid in circumferential and in upward direction, it is guide further through the helically extending part 24 of the slot 20.

The bottom surface 27 of the skirt 17 is provided with inserts 26 of an abrasion resistant material so as to promote the drilling of the borehole further and so as to protect said bottom surface against excessive wear during the rotation of the distance holder 1 together with the drill string 2. Similarly, the outer surface 22 of the skirt is provided with abrasion resistant material deposits 28. Examples of these materials include tungsten carbide, polycrystalline diamond (PDC) and thermally stabilised polycrystalline diamond (TSP). Preferably, the deposits 28 comprise tungsten carbide, and the inserts comprise TSP.

What is claimed is:

1. A distance holder for connection to, and rotation with, a drill string in an earth formation drilling device arranged to supply a jet of abrasive fluid for the purpose of providing a borehole by removing earth formation material through abrasion, said borehole having an axis and said distance holder having an axis of rotation and comprising a chamber that is essentially rotationally symmetric and faces the earth formation material, and a jet nozzle arranged for discharging the jet of the abrasive fluid in said chamber, said jet having a path, wherein the chamber includes a deflector positioned in the path of the fluid jet discharged from the jet nozzle, wherein the deflector comprises an inwardly facing planar deflector surface, and wherein the jet nozzle has a center line and wherein the planar deflector surface and a radial plane that includes the center line of the jet nozzle enclose a first angle that differs from 90 degrees such that colliding with the deflector surface gives the fluid jet a component in a circumferential direction.

2. The distance holder according to claim 1 wherein the jet nozzle is oriented obliquely with respect to the axis of rotation for making the jet of abrasive fluid intersect the borehole axis.

3. The distance holder according to claim 2 wherein the deflector is oriented for deflecting the jet of abrasive fluid in a direction having a second angle ($\beta$) with respect to the axis of rotation which is smaller than the third angle ($\alpha$) enclosed by the jet nozzle and said axis of rotation.

4. The distance holder according to claim 2 wherein the jet nozzle and the axis of rotation enclose an angle ($\alpha$) and the deflector and the axis of rotation enclose an angle ($\beta$) and the angle ($\alpha$) enclosed by the jet nozzle and the axis of rotation is approximately twice the angle ($\beta$) enclosed by the deflector and the axis of rotation, when seen in a section according to a radial plane that includes the center line of the jet nozzle.

5. The distance holder according to claim 1 wherein the chamber has an outermost end and a circumference and wherein the outermost end of the chamber comprises a skirt that extends over at least a part of the circumference of the chamber, said skirt being provided with at least one slot, said deflector adjoining said slot.

6. The distance holder according to claim 5 wherein the deflector extends slantingly between an end adjoining the skirt and an end adjoining the slot.

7. The distance holder according to claim 5 wherein the skirt has an outer surface and an inner surface each having a radius, and the deflector near or at the end adjoining the skirt has a radius that is substantially the same as the radius of the skirt inner surface and at the end adjoining the slot has a radius that is substantially the same as the radius of the skirt outer surface.

8. The distance holder according to claim 1 wherein the deflector comprises at least one plate.

9. The distance holder according to claim 1 wherein the deflector comprises tungsten carbide.

10. The distance holder according to claim 1 wherein the chamber has a trumpet-shaped inner surface.

11. The distance holder according to claim 10 wherein the trumpet shaped surface comprises a radially extending recess, the jet nozzle discharging in said recess.

* * * * *